US006394339B1

(12) United States Patent
Giblin

(10) Patent No.: US 6,394,339 B1
(45) Date of Patent: May 28, 2002

(54) THERMOFORMED CLOSURE FOR CARTONS

(75) Inventor: Edward John Giblin, Hopatcong, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/474,158

(22) Filed: Dec. 29, 1999

(51) Int. Cl.[7] ..... B65D 5/74; B65D 39/04

(52) U.S. Cl. ..... 229/125.14; 229/125.09; 229/134

(58) Field of Search ..... 229/125.09, 125.14, 229/125.15, 134; 220/359.1, 359.2, 359.3; 156/69

(56) References Cited

U.S. PATENT DOCUMENTS

| | | | | |
|---|---|---|---|---|
| 2,521,208 A | * | 9/1950 | Eaton | 229/134 |
| 3,017,067 A | * | 1/1962 | Parks | 229/134 |
| 4,250,994 A | * | 2/1981 | Focke | 229/134 |
| 4,732,315 A | | 3/1988 | Gunn | |
| 4,782,996 A | * | 11/1988 | Spahni, Jr. | 229/125.09 |
| 4,981,256 A | * | 1/1991 | Giblin et al. | 229/125.14 |
| 4,990,200 A | * | 2/1991 | Heinz | 156/69 |
| 5,108,029 A | * | 4/1992 | Abrams et al. | 229/125.09 |
| 5,158,633 A | * | 10/1992 | Rausing | 229/125.14 |

FOREIGN PATENT DOCUMENTS

| | | |
|---|---|---|
| DE | 29 44 344 A | 5/1980 |
| EP | 0 947 433 A | 10/1999 |

OTHER PUBLICATIONS

International Search Report dated Apr. 2, 2001.

* cited by examiner

*Primary Examiner*—Gary E. Elkins
(74) *Attorney, Agent, or Firm*—Gerard J. McGowan, Jr.

(57) ABSTRACT

A closure for attachment to a carton. The closure comprises a base and a cover. The base includes a debossment or trough which facilitates adhesion of the closure to the carton, e.g. with hot melt. The surface of the carton to which the closure is being attached may have a debossment instead of or in addition to that of the closure.

9 Claims, 3 Drawing Sheets

THERMOFORMED CLOSURE FOR CARTONS

BACKGROUND OF THE INVENTION

A decade or so ago, powdered detergents having a density higher than had previously been the case began to appear in the market place. The new higher density powders were packaged in cartons more suitable for the increased weight of product relative to previous powders. These cartons typically included single or parallel perforated lines of weakness which were unzipped to open the carton. Often a plastic scoop was included in the carton to enable the consumer to dispense measured amount of product neatly.

While the scoop has proved to be a convenient way to dispense powders, its inclusion in the package posses some difficulties for the manufacturer. For instance, it is necessary to fill the carton in such a way that the scoop is not buried in the powder. Otherwise, the consumer would need to paw through the powder to locate the scoop.

Prior to the decrease in the use of conventional powdered detergent cartons, which occurred with the arrival of the higher density powders, efforts were made to improve the pourability of powders from such cartons. Examples of these efforts may be found in Gunn et al., U.S. Pat. No. 4,732,315, Heinz et al., U.S. Pat. No. 4,990,200 and Giblin et al., U.S. Pat. No. 4,981,256. An issue with these plastic closures was the ability to adhere them efficiently and reliably to the cartons.

SUMMARY OF THE INVENTION

The present invention is directed to the discovery of a better way to adhere plastic closures to either conventional or high density detergent powder cartons. The invention comprises a closure having a base and a cover attached to a base. The base includes a debossment or trough on the side opposite the cover to facilitate attachment of the base to a container. Alternatively, the debossment or trough may be disposed on the surface of the carton to which the closure is being applied or on both the carton and on the closure. Typically the container will be a carton for powdered detergents or other consumer products such as the following pourable, powdered products: freshener, baby food, automatic dishwashing detergent powder and cocoa mix.

The closure will generally be made of a thermoplastic material. The debossment may be in numerous forms, such as a rectangle or a square or most preferably a rectangle or square where each line of the rectangle or square intersects another line on opposite ends and extends past each such intersection.

Generally the base and cover are attached at one of their ends to keep the base and cover closed. Typically one of the base and cover include an embossment and the other of the base and cover includes a debossment or opening dimensioned to receive the embossment when the closure is closed. The embossment and the corresponding debossment or opening may be in any of several shapes including a tear-drop, a shield or a horseshoe shape. A centered, rippled (corrugated) lift tab may be present in the cover to facilitate opening by the consumer. The attachment between the cover and the base may include a living hinge and so may be repeatedly opened and reclosed.

Some prior closures had a completely flat underside to the base, and during application hot melt had to be spread and flattened as much as possible. No matter how much pressure was applied, there still was a small gap between the closure and carton surfaces. Not only was the gap aesthetically unappealing, but the gap sometimes engaged other edges, causing jams and other manufacturing problems.

In its preferred embodiment, the present closure has the centered lift tab with ripples to facilitate lifting, it has extensions on both sides of the tab to provide a straight edge for machine handling and application, and it has the peripheral trough or debossment in the underside of the base to receive and "confine" hot-melt adhesive to functional parameters. The trough profile is shaped for improved carton adhesion and optimum bead width for attachment to the paperboard carton without powder sifting and with minimal or no carton/closure gap.

For a more complete understanding of the above and other features and advantages of the invention, reference should be made to the following description of up the preferred embodiments.

DETAILED DESCRIPTION OF THE INVENTION

Figure 1:
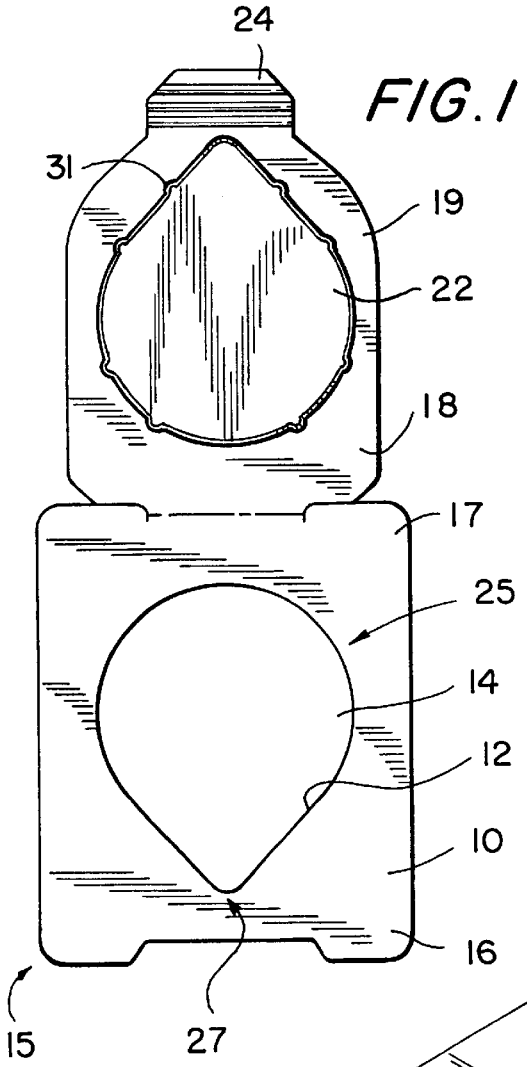
FIG. 1 is a top plan view of an opened closure.
Figure 2:
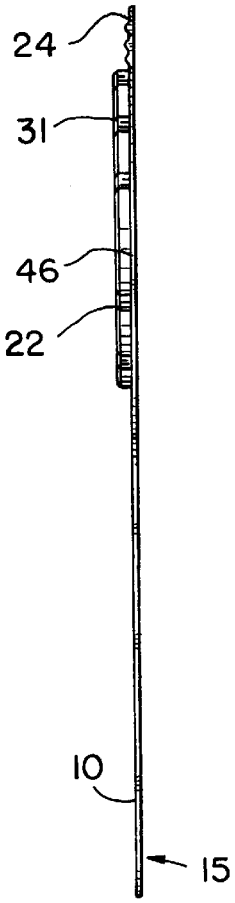
FIG. 2 is a side elevational view thereof.
Figure 3:
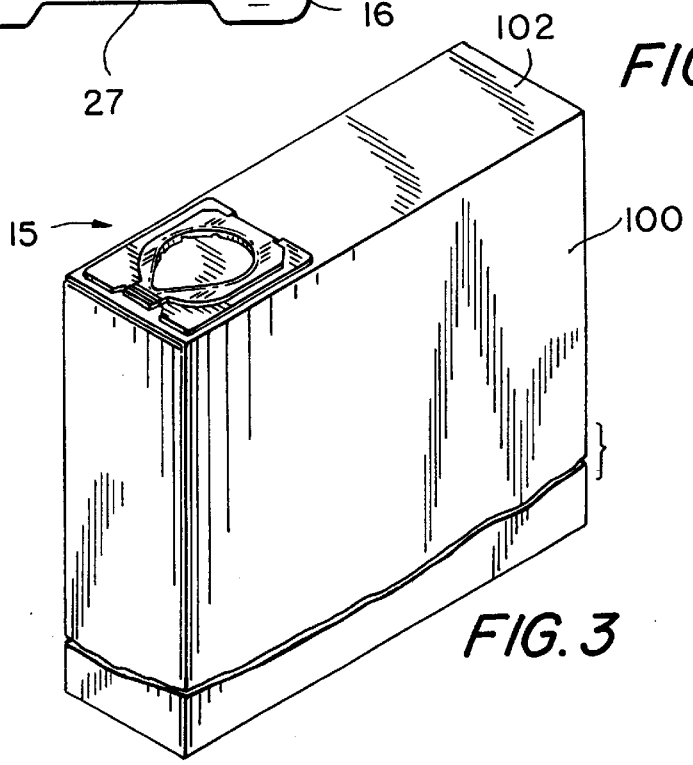
FIG. 3 is a perspective view of a carton to which the fitment has been affixed.

Referring to FIG. 1, a fitment closure, or spout 15 comprises a base 10 having centrally disposed therein a wall 12 defining a teardrop-shaped aperture 14 surrounded by base peripheral flange 17. Two arms 16 extend from the bottom of the base at either side. A cover member 18 is hingedly associated with the base. Cover member 18 includes a generally teardrop-shaped plug or embossment 22 formed therein disposed centrally within the cover member and a cover peripheral flange 19 surrounding the plug. The cover member also includes a rippled (corrugated) lift tab 24 to permit the consumer to grasp the cover member easily when opening the fitment. Wall 46 of depending plug or debossment 22 has detent nubs 31, which assist in keeping the fitment securely fastened when cover member 18 is closed by snapping plug 22 into aperture 14.

Figure 4:
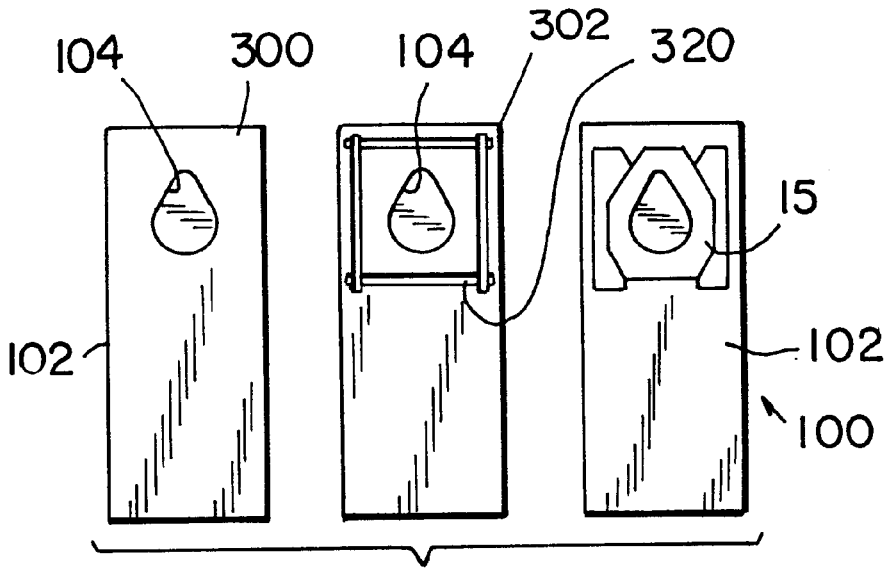
FIG. 4 is a top plan view of cartons shown before and after application of the closure.

Advantageously, the teardrop-shaped aperture comprises a top half in the shape of an arc 25 and a bottom, generally V-shaped aspect 27. It is advantageous that the teardrop-shaped aperture of the invention be arranged such that the narrow end be at the bottom or pouring end of the fitment, as illustrated in FIG. 4. Fitment 15 is preferably a plastic such as glycol-modified polyethylene terephthalate (PETG), polyethylene terephthalate (PET), polypropylene, polyethylene, including high density polyethylene, and coextrusions and laminations of any of the aforementioned plastics. High density polyethylene, PET and polypropylene are particularly preferred. The fitment may be fabricated from a thin plastic to minimize the thickness of the fitment.

The carton is erected in the usual manner, except that the carton will include a dispensing aperture in two of its panels.

Hereinafter, the carton is illustrated as having the aperture in its top panel. In general, the carton is erected by placing folded, tubular carton blanks in a carton magazine, opening a carton and placing the carton in a cartoner. In the cartoner, the bottom minor flaps are tucked in, the bottom major flaps are opened at a 90° angle, hot melt adhesive is applied, the bottom major flaps are folded and the carton is compressed to effect sealing. Subsequently the carton is filled, the top minor flaps are tucked in the top major flaps are opened to a 90° angle and hot melt adhesive is applied, after which the top major flaps are folded and the carton is again compressed for sealing. The thus erected carton 100 having an aperture 104 in its top panel 102 is then discharged from the cartoner, turned 90° and fed into an apparatus for affixing the closure to the carton. A suitable apparatus with appropriate modifications is illustrated in Heinz, U.S. Pat. No. 4,990,200.

As seen in FIG. 4, prior to application of the closure or fitment, the tops of cartons 300, 302 will include a tear-drop aperture 104. The aperture will extend through the first top panel, the second top panel and a portion of one of the top side flaps.

Figure 5:
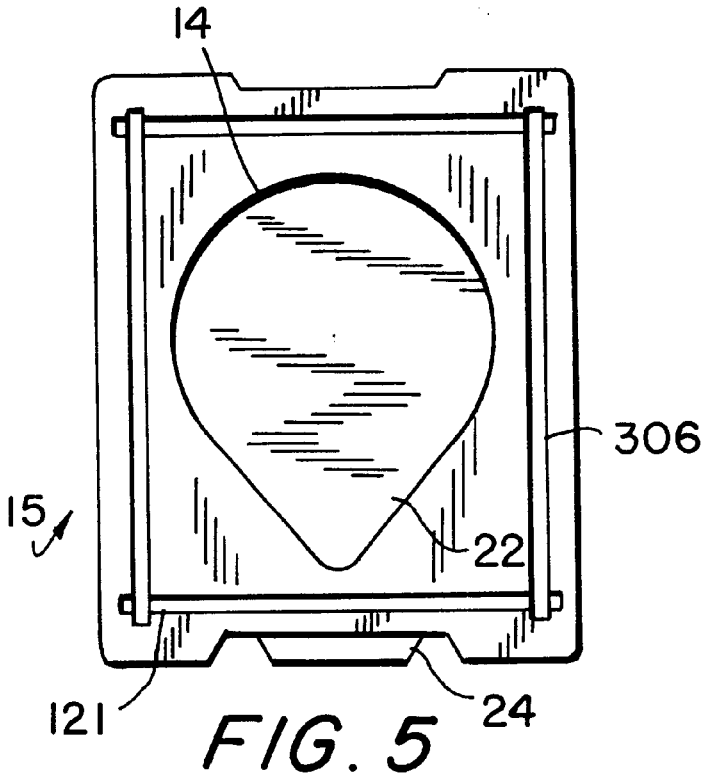
FIG. 5 is a bottom plan view of a closed fitment prior to application of adhesive.

As seen in FIG. 5, the underside of base 10 is provided with a debossment 306 which surrounds all or a portion of tear-drop shape aperture or opening 14. As illustrated in FIG. 5, debossment 306 takes the form of a rectangle wherein each of the lines extends slightly beyond the points of intersection with other lines. Again, however, it is not necessary that the exact configuration for the debossment shown in FIG. 5 be used. The purpose of the debossment is to accommodate hot melt or other adhesive, which can be placed in the debossment just prior to sealing of the closure 15 onto carton 300 or 302.

Figure 6:
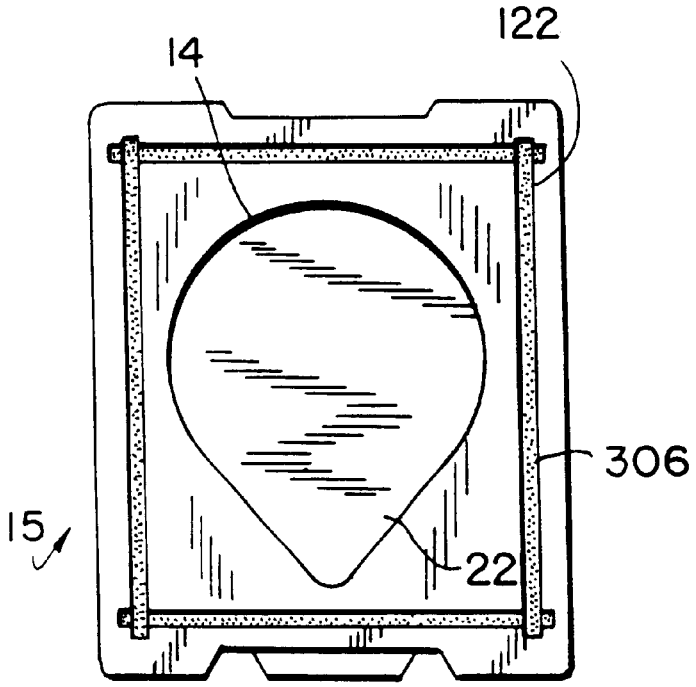
FIG. 6 is a bottom plan view of the fitment of FIG. 5 after application of adhesive.
Figure 7:
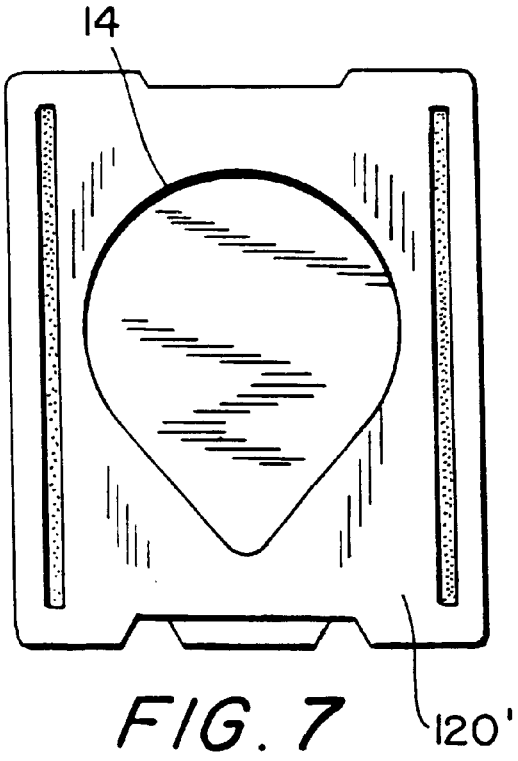
FIG. 7 is a bottom plan view of a closed fitment to which adhesive has been applied in accordance with an alternate embodiment of the invention.

FIG. 6 illustrates closure 15 after adhesive has been applied to the debossment 306.

It will be noted that the pattern applied preferably results in an endless, uninterrupted rectangle 122 of adhesive surrounding aperture 14 of the fitment. It is important that the adhesive pattern be uninterrupted to ensure that when cover 18 is secured by snapping plug 22 into aperture 14, product which exits carton dispensing aperture 104 is not able to leak through any interruptions in the adhesive sealing the rear of the fitment to the carton.

Once adhesive has been applied, the fitment is conveyed to a position just above carton aperture 104 and is then placed on the carton. Subsequently, the spout and carton are compressed to seal them together. The erected carton having a closed fitment sealed to the top panel is shown in FIG. 4.

Carton 302 of FIG. 4 illustrates an alternative embodiment wherein debossment 320 is formed on the surface of the carton in addition to, or instead of, the debossment in the closure underside.

The cartons used in the present process may be fabricated of any material normally used for that purpose. Paperboard, or paperboard laminated with one or more plastic layers, is particularly preferred. However, the carton panels may be plastic, per se, if desired. The fitment is affixed to the carton with any suitable means which can be applied by the glue applicators, especially hot melt or silicone-based cold adhesive.

Although the invention herein has been described with respect to a particular teardrop-shaped fitment, as mentioned above, other shaped fitment embossments, eg. shield or "horseshoe" shaped openings in the base and mating plugs in the top/lid may be used.

As seen in, eg., FIG. 5 there are base extensions on either side of the tab which are even with and "square off" that edge, and this makes it easier for machine handling and application of the closure. The peripheral "trough" or debossment in the underside of the base accepts hot melt adhesive and allows the closure to be attached closer to the surface of the carton with minimal or no gap. The trough also controls hot melt contact with closure and carton surfaces.

The new closure is intended for cartons containing powders, such as laundry detergent powder. The closure can be repeatedly opened and reclosed due to the living hinge. Preferably the closure is made of a barrier plastic material such as polyethylene terephthlate (PET) so there is no loss of barrier due to the closure. PET also makes a durable hinge on the folded closure. Other plastic materials could be used such as HDPE, PP, PVC, HIPS and others.

The trough or adhesive debossment is preferably spaced a distance from the edge of the closure base.

Preferably, the closure is attached to the carton, on the powders filling line and before carton filling. The rectangular hot-melt seal would prevent powder fines from sifting, and would provide a moisture barrier at the carton/closure interface which also would help prevent powder clumping. The depth and width of the trough is designed so that most of the hot melt stays within and fills the trough. Only the amount of hot melt needed for satisfactory attachment to the carton actually contacts the flat carton surface and arch of the trough. This greatly reduces or eliminates the amount of hot melt that is pressed and smeared on the adjacent flat portions of the closure's underside and carton.

The closures may be adhered to the top or to the side of the closures with teardrop or shield-shaped openings are preferred for application to the top of the carton. These closure openings have a forward "V" shape which helps direct the direction and flow of powders. The carton flaps, of course, will need to be die-cut with matching openings to allow powder to be poured from the carton. By putting a die-cut opening in the top of the carton, a special hot-melt pattern is needed to seal around the opening and the carton's major and minor flaps on the production line so there is no powder sifting.

The "horseshoe" shaped opening is preferred for the sidewall of the carton. This closure can be made slightly smaller due to the shape of the opening, and will fit better on the side of the carton. A sidewall closure does not interfere with top flap sealing and a regular hot-melt sealing pattern can be used. The bottom of the horseshoe opening will be above the powder fill line inside the carton, so there will be no powder leakage upon first opening the horseshoe closure.

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A closure comprising a base, and a cover attached thereto, said base having two sides, a first side for attachment to a container, and a second side facing said cover, one of said base and cover including an embossment, the other of said base and cover including a debossment or opening dimensioned to receive said embossment when said closure is closed, the base comprising an adhesive debossment in said first side for receiving adhesive to facilitate attachment to a container, said base and cover movable into at least two positions with respect to each other, a closed position wherein said embossment is received within said opening or debossment and an open position spaced from the closed position wherein said embossment is not received within said opening or debossment.

2. The closure according to claim 1 wherein said closure is thermoplastic.

3. The closure according to claim 1 wherein said cover includes an embossment and said base includes the opening or debossment for receiving the embossment.

4. The closure according to claim 1 wherein said adhesive debossment forms at least a rectangle or square.

5. The closure according to claim 1 wherein said adhesive debossment forms at least a rectangle or square and each line of the rectangle or square intersects another line on opposite ends and extends past said intersection.

6. The closure according to claim 1 wherein said embossment is in the shape of a teardrop.

7. The closure of claim 1 adhered to a carton by adhesive disposed partly within said adhesive debossment.

8. A carton having an opening for dispensing product and a debossment at least partly surrounding the opening to facilitate sealing of a closure.

9. The carton according to claim 8 wherein said debossment completely surrounds the opening.

* * * * *